US011446560B2

(12) United States Patent
Dittemore et al.

(10) Patent No.: US 11,446,560 B2
(45) Date of Patent: Sep. 20, 2022

(54) GOLF BAG SAVER

(71) Applicants: Ron Dittemore, Ogden, UT (US); Gary Dittemore, Salt Lake City, UT (US)

(72) Inventors: Ron Dittemore, Ogden, UT (US); Gary Dittemore, Salt Lake City, UT (US)

( * ) Notice: Subject to any disclaimer, the term of this patent is extended or adjusted under 35 U.S.C. 154(b) by 337 days.

(21) Appl. No.: 16/826,089

(22) Filed: Mar. 20, 2020

(65) Prior Publication Data

US 2020/0215409 A1 Jul. 9, 2020

Related U.S. Application Data

(63) Continuation of application No. 15/810,385, filed on Nov. 13, 2017, now abandoned.

(51) Int. Cl.

| | |
|---|---|
| ***A63B 71/00*** | (2006.01) |
| ***A63B 57/60*** | (2015.01) |
| ***A63B 1/00*** | (2006.01) |
| ***A63B 55/40*** | (2015.01) |

(52) U.S. Cl.

CPC ..... *A63B 71/0036* (2013.01); *A63B 1/00* (2013.01); *A63B 57/60* (2015.10); *A63B 55/40* (2015.10); *A63B 2209/00* (2013.01)

(58) Field of Classification Search

CPC ..... A63B 71/0036; A63B 57/60; A63B 1/00; A63B 55/40; A63B 2209/00

See application file for complete search history.

(56) References Cited

U.S. PATENT DOCUMENTS

| | | | | |
|---|---|---|---|---|
| 3,575,371 | A * | 4/1971 | Carlstedt | F16G 11/046 24/129 B |
| 3,667,078 | A * | 6/1972 | Distasio | A63B 55/10 206/315.6 |
| 4,100,652 | A * | 7/1978 | Carlson | A63B 55/40 24/336 |
| 4,475,676 | A * | 10/1984 | Smith | A63B 57/30 24/3.12 |
| 4,932,523 | A * | 6/1990 | Yamazoe | A63B 60/64 206/315.6 |
| 5,636,734 | A * | 6/1997 | Smith | A63B 55/40 206/315.6 |
| 5,802,681 | A * | 9/1998 | Riley | A47C 31/11 297/228.11 |
| 6,209,766 | B1 * | 4/2001 | Kwon | A45F 5/021 224/684 |

(Continued)

*Primary Examiner* — Tri M Mai

(74) *Attorney, Agent, or Firm* — Amy Fiene; James Sonntag

(57) ABSTRACT

A protective device for a golf bag includes a panel member folded over to form a U-shape such that a first and second protective member extend from sides of a common midsection. At least one retention element is located on an inner facing surface of at least one of the first and second protective members to attach at least one of the first and second protective members to a first divider wall so as to prevent movement of the protective device relative to the golf bag. A notch on the first protective member is dimensioned to allow for an intersection of a second divider wall with the first divider wall. A cutout on the panel member enables the panel member to bend to conform to the first divider wall and any given curvature of the first divider wall.

19 Claims, 17 Drawing Sheets

(56) References Cited

U.S. PATENT DOCUMENTS

| | | | | |
|---|---|---|---|---|
| 7,185,665 | B2 * | 3/2007 | You | F16B 7/1427 206/315.3 |
| D556,027 | S * | 11/2007 | Cuzzocrea | D8/373 |
| D583,417 | S * | 12/2008 | Maier-Hunke | D19/65 |
| 2006/0213036 | A1 * | 9/2006 | Flowers | A41F 17/02 24/72.1 |
| 2007/0241008 | A1 * | 10/2007 | Weavind | A63B 55/40 206/315.6 |

* cited by examiner

GOLF BAG SAVER

BACKGROUND

Golf is a very popular outdoor sporting game that is played on a golf course. The game involves different golf clubs, for example, woods, irons, and putters, each selected to impart an optimal drive to a golf ball towards a target or hole during a specific phase of the game.

For easy storage and convenient transportation to and from golf courses and between holes, the golf clubs are usually kept together in a golf bag. To that end, a conventional golf bag is partitioned to provide individual compartments for storing the different types of golf clubs. Partitions may include a plastic molded top collar, divider walls, or straps that extend across the opening of the bag. Other types of partitions include inserts that extend at least partially, or a full length from a top collar of the bag to a bottom member of the bag.

Soft, non-abrasive fabrics and other materials are sewn or attached to cover the partitions or straps to further protect the clubs from constant rubbing of shafts and grips that result in damage to the clubs. Over time, the partitions and coverings become damaged due to abrasion from insertion and removal of golf clubs. The fabrics, plastic, and other materials start to wear and break down.

Consequently, improvements and enhancements to golf club bags are needed to further their life.

DETAILED DESCRIPTION

Figure 1:
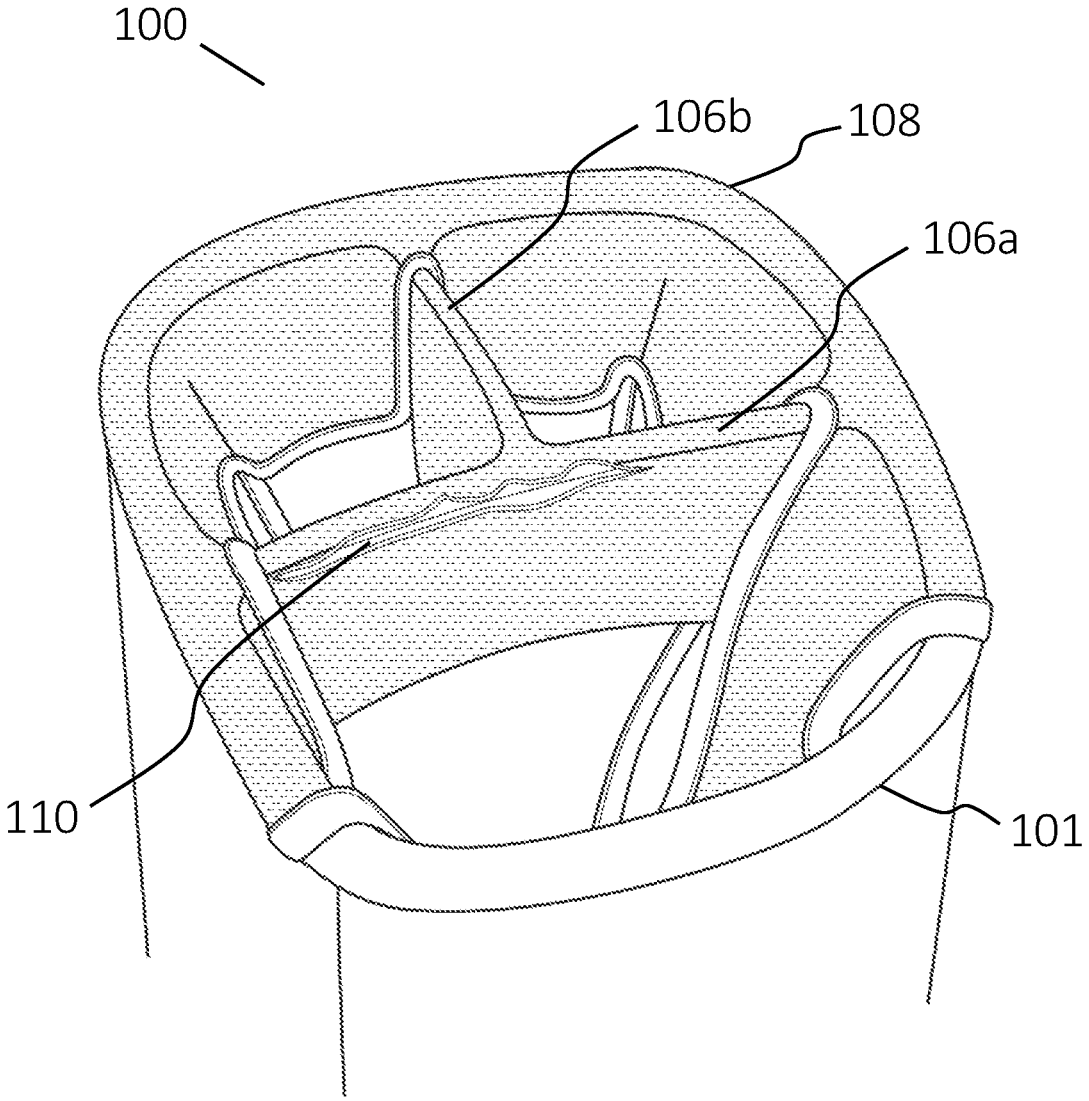
FIG. 1 illustrates a perspective view of a conventional golf bag.

The following relates to protective devices for golf bags.

An exemplary protective device for a golf bag comprises a panel member shaped to conform to at least a portion of one or more top edges of interior partitions of a golf bag.

Also, an exemplary protective device is intended for a golf bag that has interior partitions that extend across the opening of the bag. The covering comprises a panel member with an inverted U-shape cross-section configured to be removably disposed over and extending along a top of a partition with protective members extending down sides of the partition.

A conventional golf bag is designed to keep golf clubs organized and promote quick and easy retrieval of the various clubs during a game. It is also designed to prevent the handles from rocking about in the bottom of a golf bag during transportation or from becoming entangled with each other which may cause damage, breakage or undesirable scratches. For example, good golf bags are typically formed with a number of small compartments which are small enough to limit excessive and undesirable movement of the clubs.

A typical golf bag is an elongate bag with a rigid molded top collar and a closed molded bottom member at its longitudinal ends together with a circumferential enclosure extending between the top collar and the bottom member. The bag generally includes a hollow and substantially cylindrical body. The bottom end of the bag is closed while the top end remains open. The longitudinal length of the cylindrical body is approximately equal to the length of the golf clubs.

Small compartments are generally formed by rigid or flexible partitioning members or dividing straps which are taut and which extend between the molded top collar member and the molded bottom member of the golf bag. To provide for a framework of compartments, a rigid partitioning member forming a grid of rigid ridges which defines the peripheral walls of the compartments is usually formed across the aperture defined by the top collar member. Partitioning members may extend between the molded top collar member and the molded bottom member of a golf bag. They may extend partially, such as 2"-3", 3"-4", 4"-5", 6"-7", 7"-8", 9"-10", 10"-11", 11"-12", or more. They may also extend the entire distance. For straps, flexible straps are usually made, for example, of fabric, such as nylon or polyester, which are lightweight and gentle to the shafts of golf clubs.

An exemplary collar for defining partitions may be a rigid molded top collar and the bottom a closed molded bottom at its longitudinal ends together with a circumferential enclosure extending between the top and bottom member. The top collar is usually supported from the bottom member by a plurality of rigid stays which are distributed around the edge of the bottom member and which are typically rigid plastic posts extending between the top collar and the bottom member. Golf clubs are usually stored in a golf bag with the club heads protruding above a cushioned partitioning member formed on the top collar and with the handles resting on the upper surface of the bottom member. As the bottom member has to bear almost all the weight of golf clubs, it must be reasonably strong and is usually a molded piece made of hard plastics.

The flexible partitioning members may crisscross each other, for example, with a first set of one or more partitioning members or straps running parallel to each other, and a second set of one or more partitioning members also running parallel to each other, the two sets being angled or perpendicular with respect to each other.

The partitioning members may be flexible, rigid, or semi-rigid. The material of the members may be nylon or polyester or other material. Other variations are also anticipated. The partitioning members may be coupled or otherwise attached to the golf bag. For example, the partitioning members may include fastening structure for engagement with the top collar.

Golf clubs easily wear out the upper portions of the partitions. Turning to FIG. 1, a conventional golf bag 100 is shown, including interior partitions 106*a* and 106*b*. A fabric 108 covers the partitions 106*a* and 106*b* so as to protect the partitions against wear and tear, particularly, wear and tear from abrasion due to golf clubs. It is difficult to replace a used partition with a new one. As seen, a damaged region 110 includes a tear to the fabric 108 which leaves a surface of the partition 106*a* exposed. This can make the golf clubs susceptible to abrasive forces which can damage the golf shaft and ultimately affect a golf swing if it breaks. It can also cause further damage to the golf bag 100.

Figure 2A:
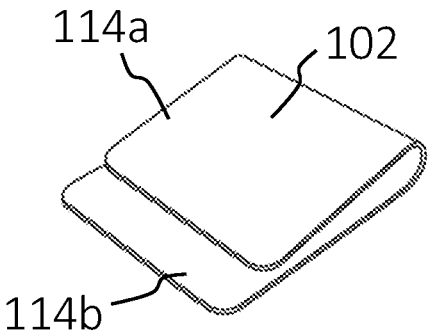
FIG. 2*a* illustrates a perspective view of an exemplary protective device.
Figure 3A:
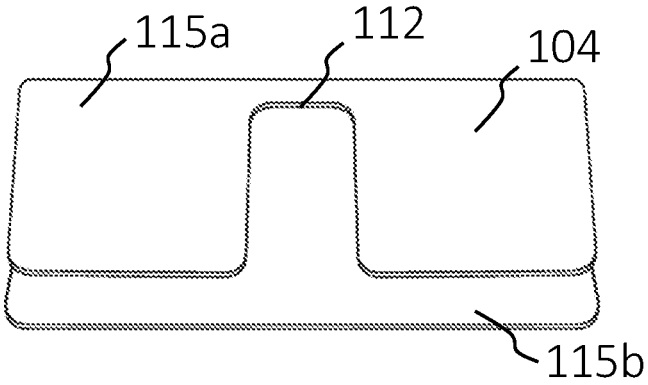
FIG. 3*a* illustrates a perspective view of an exemplary protective device.
Figure 2B:
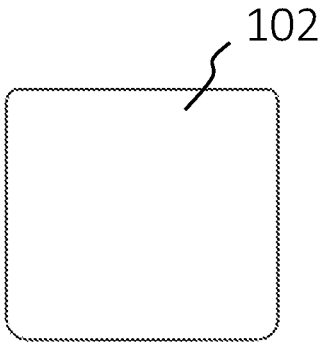
FIG. 2*b* illustrates a back view of an exemplary protective device.
Figure 3B:
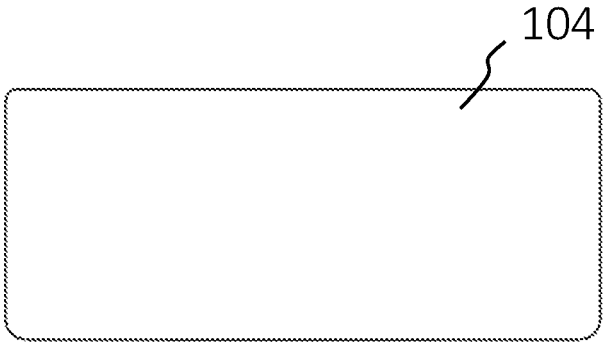
FIG. 3*b* illustrates a back view of an exemplary protective device.
Figure 2C:
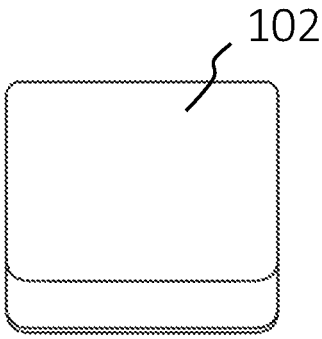
FIG. 2*c* illustrates a front view of an exemplary protective device.
Figure 3C:
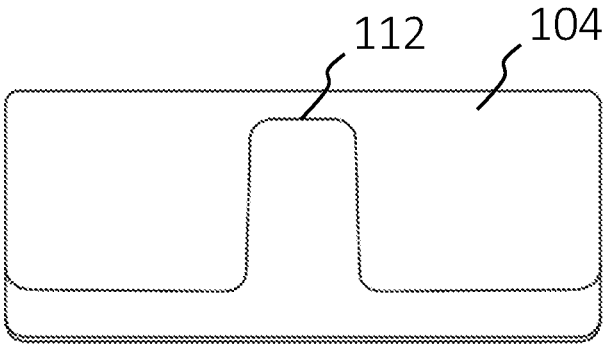
FIG. 3*c* illustrates a front view of an exemplary protective device.

Turning to FIGS. 2*a*, 2*b*, 2*c*, 3*a*, 3*b*, and 3*c*, various views of exemplary protective devices 102 and 104 are shown. The devices 102 and 104 are used to repair the golf bag and protect against the onset of further damage. FIGS. 2*a* and 3*a* depict perspective views of respective devices 102 and 104. FIGS. 2*b* and 3*b* depict back side views and FIGS. 2*c* and 3*c* depict top views. Devices come in different sizes to accommodate different dimensions of interior partitions. For example, device 102 is shown with a narrower width than device 104.

Each device is made of a flat panel member that is folded over to form an inverted U-shape cross-section such that two protective members extend from sides of the fold, the members having surfaces on a same side of the panel member that face each other, the members extending from the fold in a parallel manner. The panel member may be a rectangular shape with uniform width, and when the panel member is formed into a U-shape, the width of the front protective member and back protective member are thus equal. Variations include non-uniform width too.

Device 102 includes front protective member 114*a* and back protective member 114*b*. Device 104 includes front protective member 115*a* and back protective member 115*b*. Corners of the device are shown as being curved or rounded so as to avoid damaging the golf bag and the fabric 108 in the golf bag. Also, the rounded corners prevent scraping or cutting of golf clubs.

The front protective member 114*a* and 115*a* may have a length that is shorter than the length of the back protective member 114*b* and 115*b*. The length shown is approximately ¾ of the length of the back protective member 114*b* and 115*b*. The length may alternatively be ⅝, ⅔, or other length. Also, the length may be described as providing a 0.25", 0.30", 0.35", 0.40", 0.50", 0.55", 0.60", 0.65", 0.70", 0.75", 1.00", 1.25", 1.50", and 1.75" difference between lengths. The exemplary lengths are not to be limiting, with the lengths varying by increments of 0.01" and shorter or longer lengths anticipated. For example, a 2", 3", 4", 5", 6", and 7" difference is also anticipated, as well as other lengths. The back protective member may also have a length that extends the length of the bag or a substantial portion of the length of the bag.

The front protective members 114*a* and 115*a* are shown angled from the fold toward respective back protective members 114*b* and 115*b*. The back protective members 114*b* and 115*b* are shown flat in relation to the angled front members. After the fold, the front protective member 114*a* angles such that it gradually increases in proximity to the second protective member 114*b*. The highpoint of proximity may occur at distal ends, however, the front protective member 114*a* may be shorter in length such that it extends only a portion of the length of the second protective member 114*b*. Also, the front protective member 114*a* may have a sharp angle, such as a 60-80 degree angle that makes the front protective member extend less than the second protective member. Any range of angles is anticipated.

Instead of only the angled front protective member 114*a* having an angle, both protective members 114*a* and 114*b* may be mutually angled toward each other. One member may have a sharper angle than the other member.

Protective members may be contacting each other and then separated away from each other in a device-like manner to allow space for them to be slidably engaged to the interior partition. Having resilient properties or memory spring-like action allows the protective members to move toward each other upon release and result in a clamp hold around the interior partitions. This makes the device stay in place.

Ends of front protective members 114*a* and 115*a* may come into contact with respective surfaces of back protective members 114*b* and 115*b*. Alternatively, a small gap may remain, such as a 0.01"-0.05", 0.05"-1.0", 1.05"-1.10", 1.15"-1.20". The small gap may be less than, the same, or approximately the same, as a thickness of an interior partition of the golf bag. The material of the devices may have properties that include being resilient, flexible, elastic, or snap-like. Properties may allow the protective members to be pulled away from each other and then returned to their original position. This allows the protective members to be slidably engaged around the interior partitions for a tight friction fit as the protective members are inclined to return to their original position. Also, the material may be sufficiently rigid with a non-damaging surface with respect to materials of construction of golf clubs. The surface may be, for example, slick, smooth, or have a glossy finish. The inner facing surface of the protective members may have a different type of surface than the outer facing surface.

The devices may further include a notch, like the notch 112 shown in FIG. 3*a* and FIG. 3*c* on front protective member 115*a*. The notch 112 is an opening on the front protective member that allows the device to fit around intersecting walls of interior partitions or other barriers. The notch may be located at any position from side to side of the front protective member. The notch as shown is located in the center of the front protective member. The notch 112 is dimensioned with appropriate length, height, and width to accommodate the intersecting walls, or barriers.

At the top of the notch, near the fold of the device, the notch may be square, or rectangular, with curved or rounded corners, to prevent sharp edges causing damage to the interior partitions and golf clubs. Beveling, chamfering, and other configurations for the edges of the notch are anticipated. Notch 112 is shown as being rectangular with rounded edges at top corners. The notch may extend to the fold or be located just below the fold. Notch 112 is shown being located below the fold. Exemplary heights of the notch may be located below the fold by 0.10"-0.50", 0.50"-0.75", 0.75"-1.0", 1.0"-1.25", 1.50"-1.75", 1.75"-2.00", 2.00"-2.25", and 2.25"-2.50". Also, note that more than one notch may be incorporated. Each notch may have different dimensions to accommodate the interior partitions and other barriers.

Figure 4A:
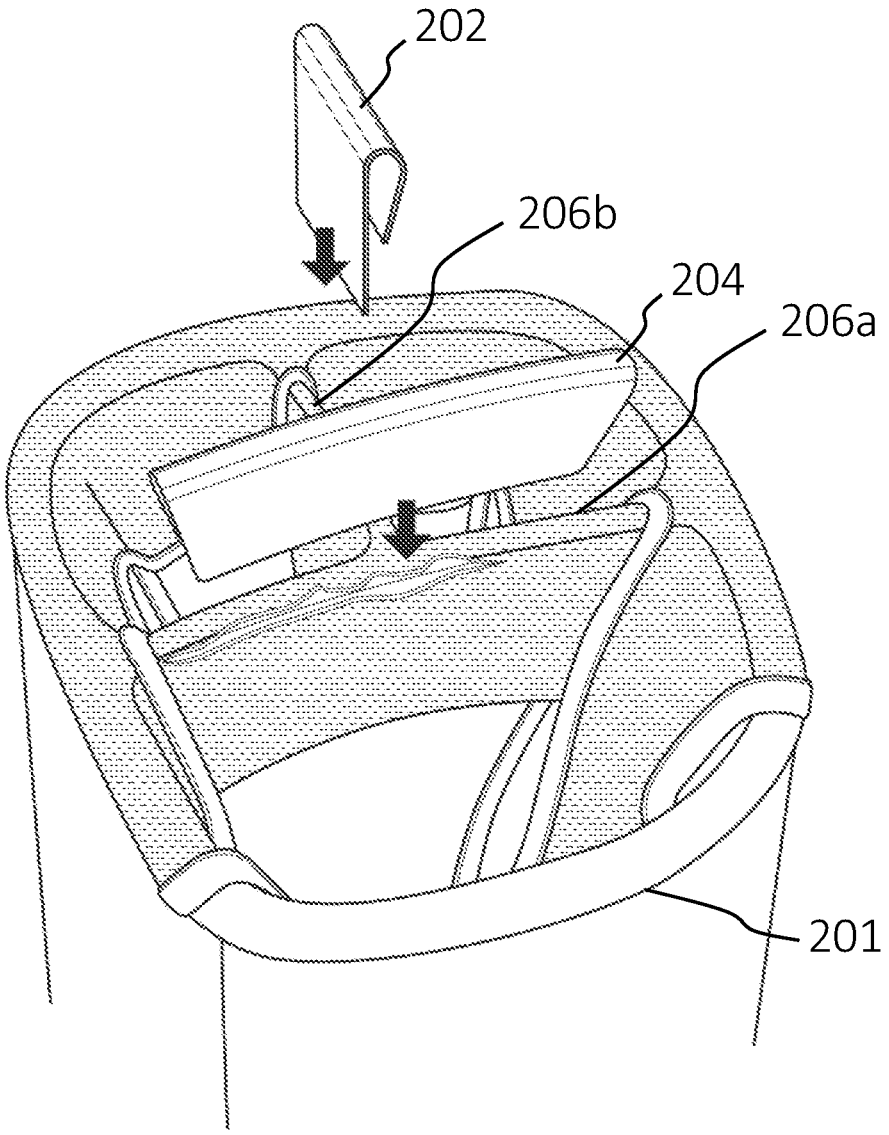
FIG. 4*a* illustrates an extruded view of two exemplary protective devices and a golf bag.
Figure 4B:
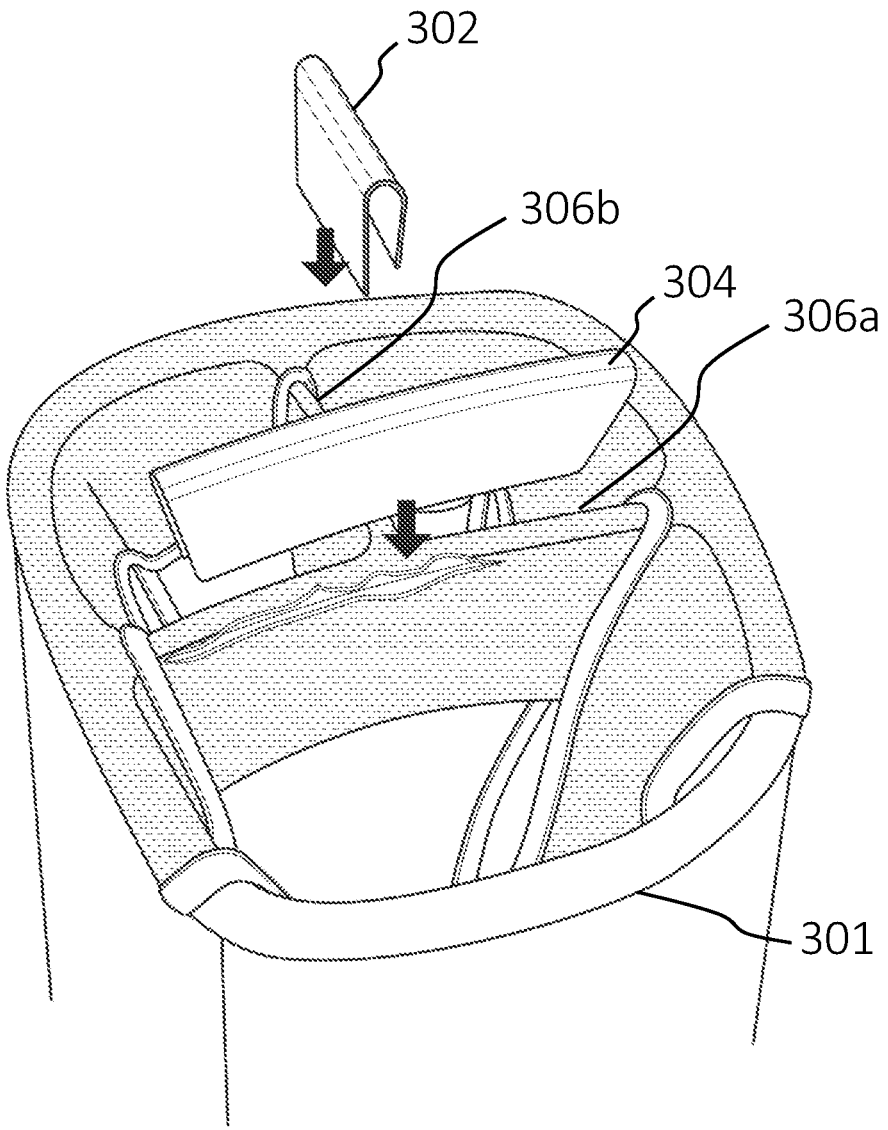
FIG. 4*b* illustrates an extruded view of two exemplary protective devices and a golf bag.

Turning to FIGS. 4*a* and 4*b*, respective devices 202 and 204 are shown being inserted into a golf bag. Device 204 is shown being used to protect a damaged area while device 202 is shown being used as a preventative measure to protect an undamaged area. Devices 202, 204, 302, and 304 are lowered into the bag around respective interior partitions 206*a*, 206*b*, 306*a*, and 306*b*. The fit may be a tight, friction fit, or alternatively, a loose fit.

Device 202 is shown with an angled front protective member 214*a* in FIG. 4*a*. Device 302 is shown with a straight front protective member in FIG. 4*b*. The straight configuration allows for a slidable engagement which can still be a friction fit or device-like fit.

Figure 4C:
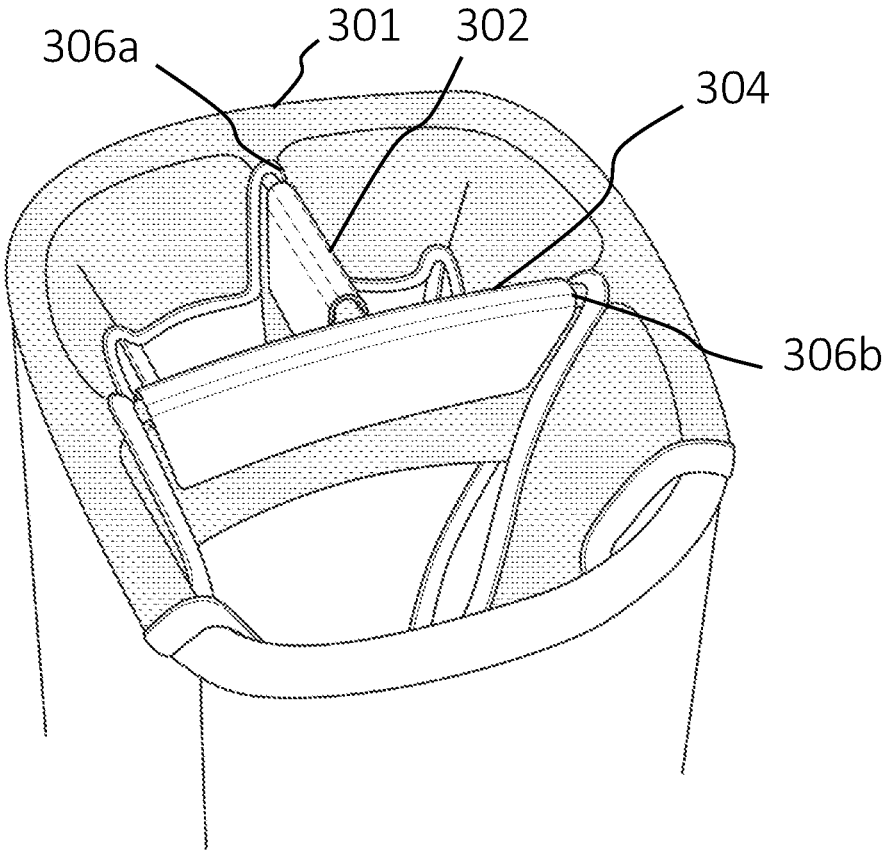
FIG. 4*c* illustrates a perspective view of two exemplary protective devices attached to a golf bag.

FIG. 4*c* shows the devices 302 and 304 after being inserted into golf bag 301. Device 302 is shown slidably engaged to interior partition 306*a*. Device 304 is shown slidably engaged to interior partition 306*b*.

Figure 4D:
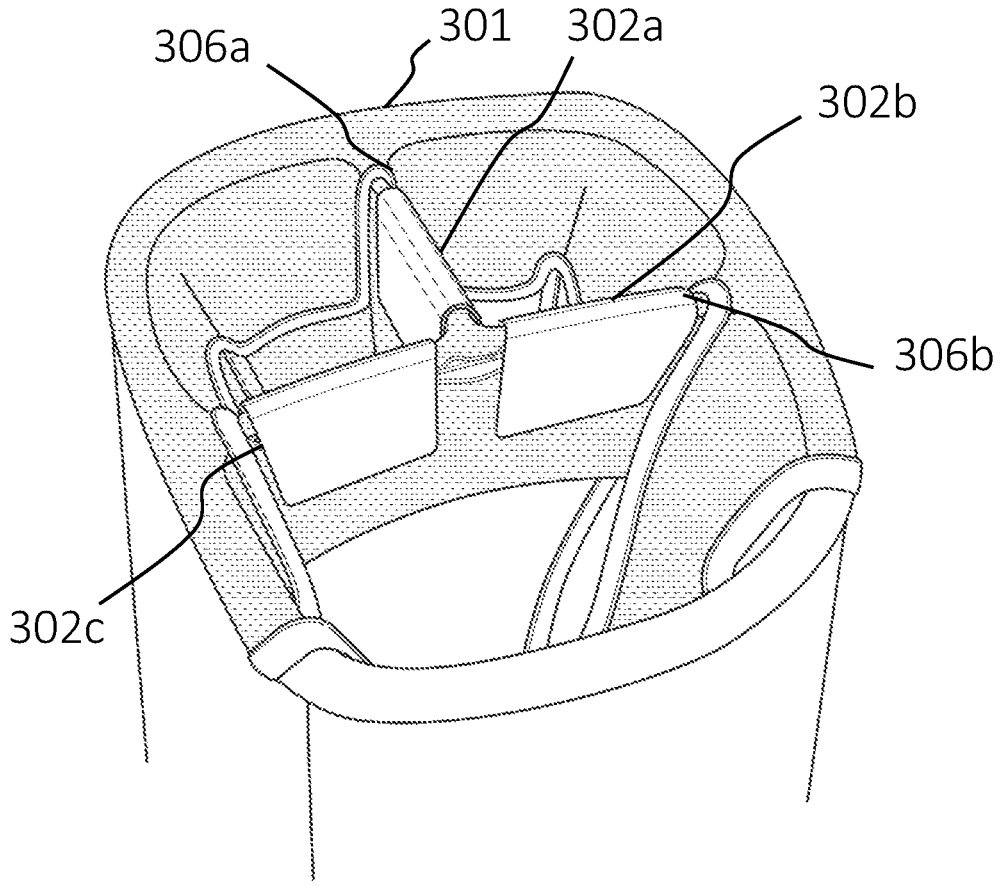
FIG. 4*d* illustrates a perspective view of three exemplary protective devices attached to a golf bag.

FIG. 4*d* shows a variation of use with a series of narrow devices 302*a*, 302*b*, and 302*c* being used to cover partitions 306*a* and 306*b*. Other variations are also anticipated.

Figure 5A:
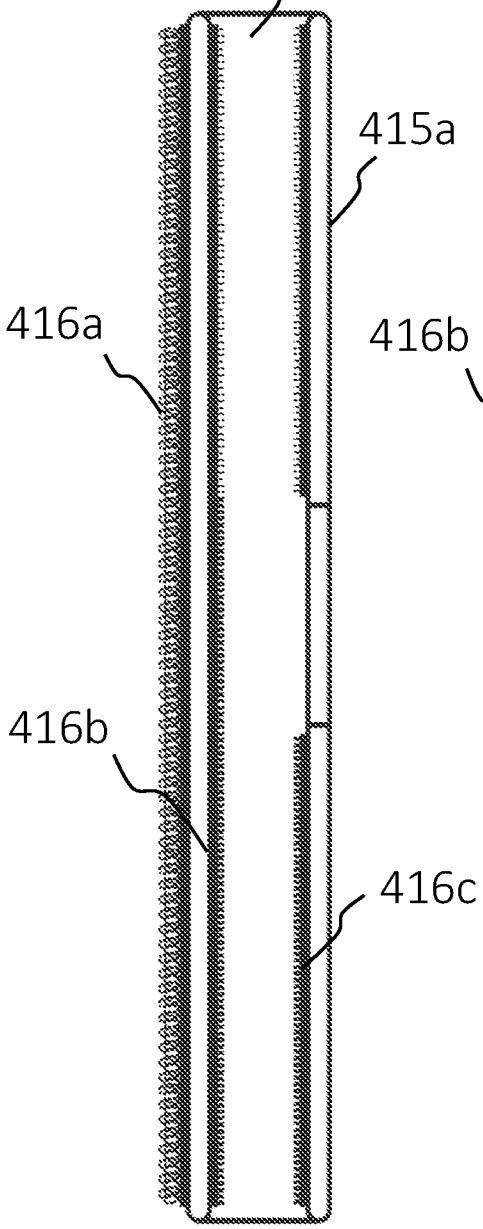
FIG. 5*a* illustrates a bottom view of a protective device that includes layers.
Figure 5B:
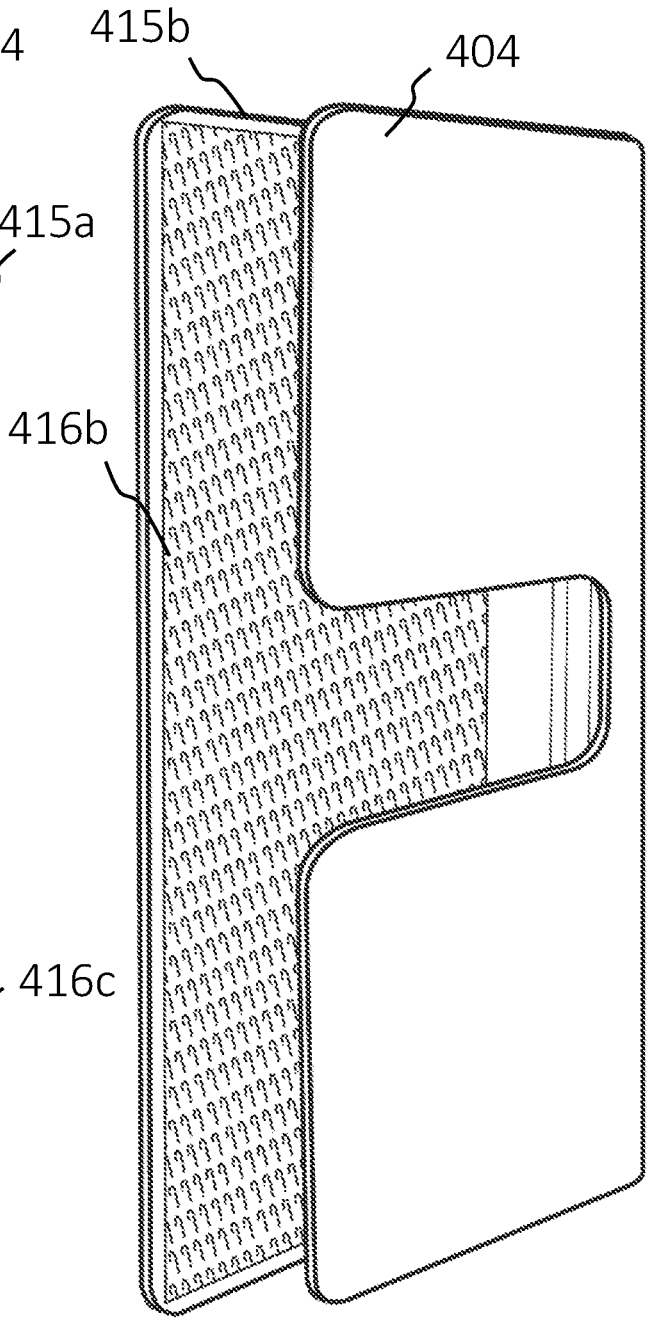
FIG. 5*b* illustrates a perspective view of a protective device that includes a layer.

Properties of the device may further be enhanced by adding one or more layers on to one or more of the front and back protective members and fold. Each layer may be of a hook and loop nature, Velcro™, a material (e.g., felt, cotton, nylon, foam, polyester, blend, canvas, rubber, etc.), or any combination thereof. The layer may cover a substantial portion or an entire surface of the front device. For example, the layer may cover an interior or exterior of the front protective member, back protective member, or notch area. As shown in FIG. 5*a*, exemplary hook and loop layers 416*a*, 416*b*, and 416*c* are attached to device 404. Layer 416*a* is attached to exterior facing surface of back protective member 415*b*. Layer 416*c* is attached to interior facing surface of front protective member 415*a*. Layer 416*b* is attached to interior facing surface of back protective member 415*b* as shown in FIG. 5*b*. Although not shown, a layer may cover an exterior facing surface of front protective member, interior facing surface of notch area, and exterior facing surface of notch area.

Figure 6:
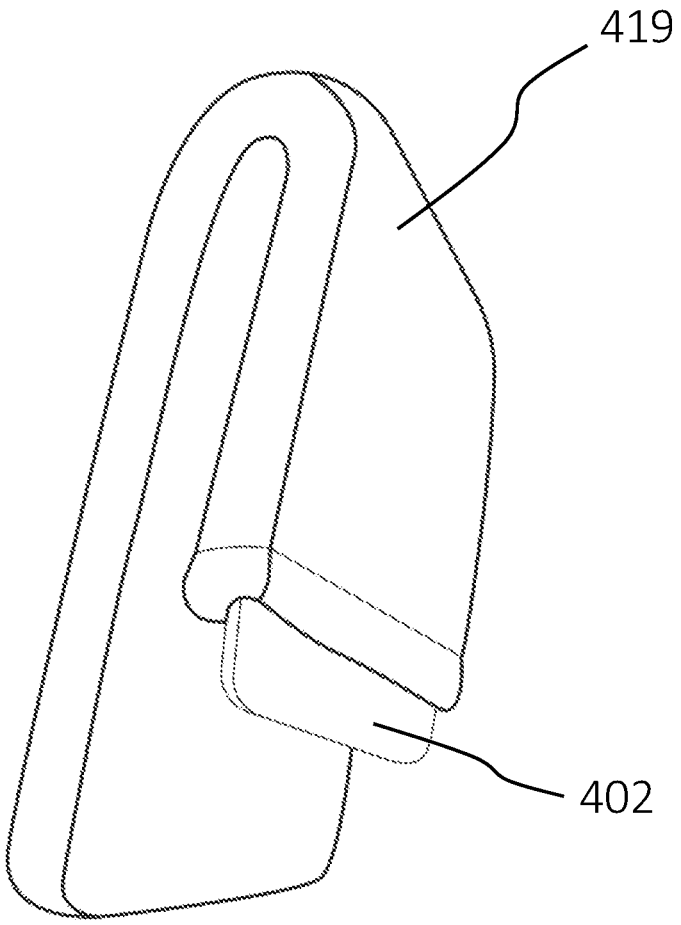
FIG. 6 illustrates a perspective view of a protective device that includes an outer shell.

As shown in FIG. 6, a device 402 includes an outer shell 419, which includes a covering with an opening that fits over the device, enclosing the covering. The covering is shown with one opening to engage the covering, but more than one opening may be had. For example, an opening may be present at both ends. Alternatively, the opening may be a side opening.

The outer shell 419 may be made of a material, such as fabric (e.g., cotton, modal, silk, rayon, wool, linen, etc.), plastic (e.g., nylon, polyester, acrylic, polymeric, vinyl, canvas, combination thereof or other material. The outer shell may further include a coating, such as a plastic coating, absorbent fabric coating, or other type of coating. Also, the outer shell may have a smooth surface or a texture, such as a rough texture, bumpy texture, or other texture.

The fit of the shell 419 may be a tight fit. For example, the shell may include elastic properties for a stretchy pull-on type fit. Also, the shell may have a closure at the base which effectively closes the opening. For example, a Velcro or hook and loop closure may be used. A zipper, snap, button, tie, and any other type of closure or locking structure known in the art may be used.

The properties of the layer may include being non-abrasive, cushioning, absorbent, water-resistant, light-weight, smooth, soft, sponge-like, as well as other properties. Note that the layers may be located around outer edges, and around edges that define a notch. Also, the layer may extend between opposite ends of a device.

Alternative constructions include the devices incorporating texture. For example, roughening, indentations, and other types of texture may be used to enhance a friction fit or provide a better surface that protects against abrasion. Also, the protective members may include an undulating wave-like surface on interior or exterior surfaces. This may support acts of engaging partitions and further enhance the tightness of the fit on partitions.

The device may be comprised of a hard material such as a hard rubber. The material should not be harder than materials used in golf-club construction, or have hard or abrasive surfaces, so that they will not damage the golf club shafts or other components. For example, the covering may be made of plastic, fiberglass, or other material. The material may be a durable, flexible material. The material may be rigid or semi-rigid sufficient to maintain the shape of the covering, and sufficient for the covering to be retained on the partition top edge. To this end, the material may further include a high friction surface adjacent the partition surface such that the material may resist twisting or deformation.

Alternative construction includes a composition of two pieces or three pieces that are connected or otherwise joined together. For example, the two protective members may be connected with a hinge or joint-like structure. In another example, the two protective members may fit together in a joined or locking manner to act as a single unit.

An example protective device for a golf bag includes a panel member folded over to form a U-shape such that a first and second protective member extend from sides of a common midsection. At least one retention element is located on an inner facing surface of at least one of the first and second protective members. The retention element is to attach at least one of the first and second protective members to a first divider wall so as to prevent movement of the device relative to the first divider wall or the golf bag. The movement may be vertical, horizontal, or angular relative to the first divider wall or the golf bag, for example. The inner and outer facing surfaces of the panel members are otherwise generally flat.

A notch is located on the first protective member and is dimensioned to allow for an intersection of a second divider wall with the first divider wall. A cutout is centrally located on the common midsection and extends from the notch on the first protective member and across the midsection to at least a portion of the second protective member. The panel member includes flexible and resilient properties to conform to, cover, and be retained on the first divider wall. The notch and cutout further enable the panel member to bend to conform to the first divider wall and any given curvature of the divider wall.

Another example protective device for a golf bag includes a panel member folded over to form a U-shape such that a first and second protective member extend from sides of a common midsection. At least one retention element is located on an inner facing surface of at least one of the first and second protective members. The retention element is to attach at least one of the first and second protective members to a first divider wall so as to prevent movement of the protective device relative to the golf bag. The inner facing surfaces of the panel members are otherwise generally flat.

A notch is centrally located on the first protective member and is dimensioned to allow for an intersection of a second divider wall with the first divider wall. A layer or coating is located on at least a portion of at least one of the first and second protective members. The panel member includes flexible and resilient properties for the panel member to conform to, cover, and be retained on the divider wall. The notch further allows the panel member to bend to conform to the divider wall and any given curvature of the divider wall. The first protective member is shorter than the second protective member.

Another example protective device for a golf bag includes a panel member folded to form a U-shape such that a first and second protective member extend from sides of a common midsection. At least one retention element is located on an inner facing surface of at least one of the first and second protective members. The retention element is to attach the first and second protective members to a first divider wall so as to prevent movement, such as vertical, horizontal, or angular movement of the device relative to the first divider wall or golf bag. Inner facing surfaces of the panel members are otherwise generally flat.

At least a portion of one of the first and second protective members includes a layer or coating. A notch is centrally located on the first protective member and is dimensioned to allow for an intersection of a second divider wall with the first divider wall. A cutout is centrally located on the common midsection and extends from the notch on the first protective member across the midsection to at least a portion of the second protective member. The panel member includes flexible and resilient properties for the panel member to conform to, cover, and be retained on the divider wall. The notch and cutout enable the panel member to bend to conform to the divider wall and any given curvature of the divider wall.

Figure 7:
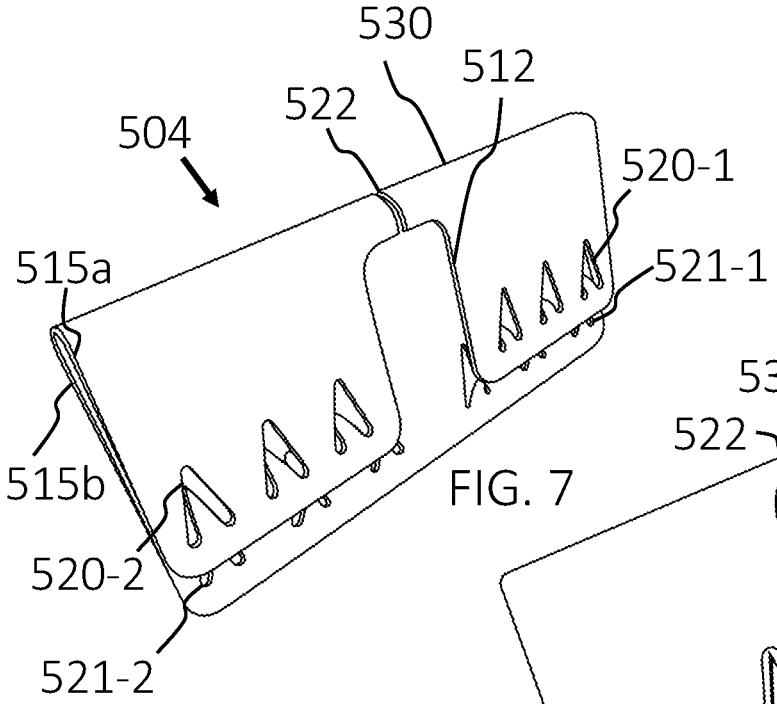
FIG. 7 illustrates a perspective view of protective device.
Figure 8:
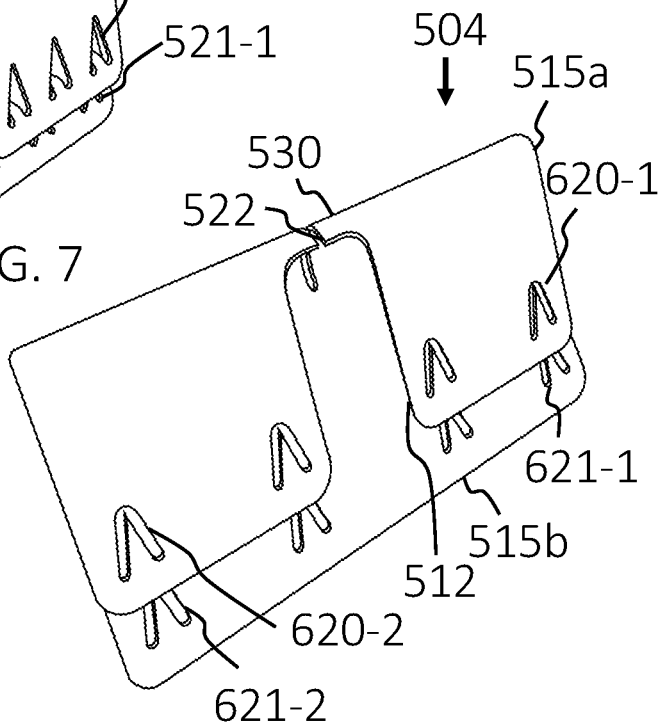
FIG. 8 illustrates a perspective view of protective device.
Figure 9:
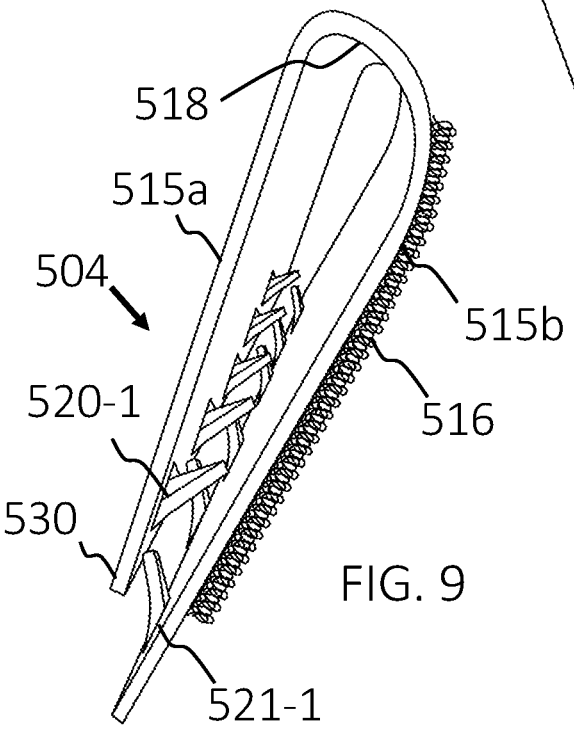
FIG. 9 illustrates a side view of a protective device.

FIGS. 7-9 illustrate various views of an example protective device 504 according to principles discussed herein. The protective device 504 includes a panel member 530 that is folded over to form a U-shape configuration, the panel member 530 having a common midsection 518 or fold region across a top of the panel member 530 and a first 515*a* and second protective member 515*b* extending from sides of the common midsection 518.

The top of the panel member 530 is considered to be on top of the midsection 518. The bottom of the panel member 530 is the bottom edge of the second protective member 515*b*, which is the lowest part of the panel member 530. In an example, the top of the panel member 530 contacts a top edge of a divider wall of a golf bag. In other examples, the top of the panel member 530 is slightly offset from a top edge of a divider wall.

The first 515*a* and second protective members 515*b* may have the same length or different lengths. As shown in FIGS. 7-9, the first protective member 515*a* has a shorter length than the second protective member 515*b*. The first protective member 515*a* and the second protective member 515*b* are slightly angled toward each other and have increasing proximity toward each other with free bottom ends being in closest proximity. Free bottom ends do not, however, contact each other. In another example, the bottom edge of the first protective member 515 does contact a surface of the second protective member 515*b*. Further examples include that the first protective member 515*a* and the second protective member 515*b* are parallel to each other or that only the first protective member 515*a* or second protective member is angled relative to the central axis that goes from the bottom to the top of the protective device 504.

At least one retention element 520-1, -2 and 521-1, -2 is located on an inner facing surface of at least one of the first 515*a* and second protective members 515*b*. Retention elements 520-1, -2 and 521-1, -2 near bottom corners are labeled to represent multiple retention elements along respective sides of the protective device 504. For example, retention element 520-1 represents all retention elements on one side of notch 522 of the first protective member 515*a* while retention element 520-2 represents all retention elements on the opposite side of the notch 522 of the first protective member 515*a*. Similarly, retention element 521-1 represents all retention elements on one half side of the second protective member 515*b* while retention element 521-2 represents all retention elements on the opposite half side of the second protective member 515*b*.

Each retention element 520-1, -2 and 521-1, -2 includes a triangular shaped prong that is cut from the panel member 530 and extended outwardly and angularly away from the inner facing surface of the respective first 515*a* or second protective member 515*b*. Retention elements 520-1, -2 are angled toward the top of the panel member 530 from an inner facing surface of first protective member 515*a*. Tops of the prongs may be sharp or they may be blunt. Retention elements 521-1, -2 are angled toward the top of the panel member 530 from an inner facing surface of second protective member 515*b*. Tops of the prongs of the retention elements 510-1, -2 are angled toward the top of the panel member 530.

Each retention element 520-1, -2 and 521-1, -2 is a cutout or punched out prong or member that is angled vertically upward and outward relative to the respective protective member to which is stems. In other words, each retention element 520-1, -2 and 521-1, -2, or at least one retention element is angled vertically upward toward the central axis of the protective device 504.

In another example, at least one retention element is angled vertically downward and outward relative to the respective protective member from which it stems.

Shapes of retention elements 520-1, -2 and 521-1, -2 may be different. For example, rather than having a single pointed edge at the free end of each triangular shape as shown, each retention element 520-1, -2 and 521-1, -2 may include multiple pointed edges. Alternatively, shapes of retention elements 520-1, -2 and 521-1, -2 may be blunt with no pointed edge. Retention elements 520-1, -2 and 521-1, -2 may not all be congruous to each other. Rather, retention elements 520-1, -2 and 521-1, -2 but may have differences from each other in shape, size, angle, edge, material, or other defining feature. In one example, at least one retention element may have a pointed edge while at least one other retention element is blunt. In another example, at least one retention element may have an angle that is more angled toward the central axis of the panel member 530 than another retention element. Instead of a straight angle, at least one retention element 520-1, -2 and 521-1, -2 may be curved or hook-like in a concave or convex manner. In an example, at least one retention element 520-1, -2 and 521-1, -2 includes at least one hook, anchor, prong, spike, or barb. The barbs may end extending upward, downward, angularly, or sideways. Moreover, multiple barbs may be present.

At least one retention element 520-1, -2 and 521-1, -2 may terminate in a curved tip to facilitate the installation of the protective device 504 on the divider wall. Such a tip may be blunt or sharp. The retention element may have a curved tip that points toward the inner surface of the respective protective member or away from the inner surface of the respective protective member.

The retention elements 520-1, -2 and 521-1, -2 may be equally spaced on respective protective members 515*a* and 515*b*. Examples include that the retention elements have non-equal spacing. As shown in FIG. 7, retention elements 520-1, -2 and 521-1, -2 are located at or adjacent to a bottom edge of the first 515*a* and second protective members 515*b* and are equally spaced apart in a single row. Retention elements 520-1, -2 are spaced from a bottom edge of protective member 515*a* at the same distance that retention elements 521-1, -2 are spaced from the bottom edge of second protective member 515*b*. Because the first protective member 515*a* is shorter than the second protective member 515*b*, the retention elements 520-1, -2, and 521-1, -2 are naturally offset from each other in a vertical direction along the central axis so that the prongs do not contact each other.

In another example, the retention elements 520-1, -2 are spaced at a different height from the bottom edge of on the first protective member 515*a* than the retention elements 521-1, -2 spaced from the bottom edge of the second protective member 515*b*.

In another example, the retention elements 520-1, -2, and 521-1, -2 are offset from each other in a horizontal direction. For example, retention elements 520-1, -2 and 521-1, -2 may be offset horizontally from each other relative to opposite facing sides of the first 515*a* and second protective members 515*b*.

In further examples, retention elements 520-1, -2, and 521-1, -2 are staggered relative to each other to form a repeated V-shape, or in other words, a chevron configuration, either defined by retention elements 520-1, -2 on the first protective member 515*a*, retention elements 521-1, -2 on the second protective member 515*b*, or defined by both retention elements 520-1, -2, and 521-1, -2 acting together. For example, one retention element 520-1 on the first protective member 515*a* may be horizontally offset and vertically lower than an opposite facing retention element 521-1 on the second protective member 515*b*. Subsequent retention elements are similarly staggered relative to each other to form the repeated V-shape.

As shown in FIG. 8, a pair of retention elements 620-1, -2 and 621-1, -2 are on opposite sides of respective protective members 515*a* and 515*b*. Pairs of retention elements 620-1, -2 are directly opposite pairs of retention elements 621-1, -2. The space between each pair of retention elements 620-1, -2 and 621-1, -2 on a side is equal. The space is the same space that would be present with a center retention element centered between each retention element 520-1, -2 and 521-1 with a space on either side of the center retention element. Notice that there is no retention element on the second protective member 621-2 that overlaps with the area that is exposed by the notch 512. In another example, a retention element is present, partially present, or substantially present, in the area that is exposed by the notch 512.

The panel member 504 may be used by itself or have a layer or coating applied to it. Examples include that the layer be located on at least one of an outer and inner facing surface of the first 515*a* and second protective members 515*b*.

Particularly, at least one layer may be bonded or otherwise attached to protect the protective device 504 and golf clubs that are to be inserted into the golf bag. Layer 516 shown on second protective member 515*b* in FIG. 9 may be a natural or synthetic fabric, or a combination of both. The material may be a hook and loop material, Velcro™, or other material (e.g., felt, cotton, nylon, foam, polyester, blend, canvas, rubber, etc.), or any combination thereof. The layer 516 may cover a substantial portion or an entire front or back portion of the first 515*a* and second protective members 515*b* of the protective device 504. As shown, the layer 516 extends from the common midsection 518 to a bottom portion of the second protective member 515*b*.

A notch 512 may be present on at least one of the first and second protective members 515*a* and 515*b*. As shown in FIGS. 7 and 8, the notch 512 includes a gap, opening, or relatively substantial opening in the first protective member 515*a* that allows the protective device 504 to fit around an intersecting divider wall within a golf bag. The notch may be located at any position from side to side of the first 515*a* or second protective member 515*b* or along both first 515*a* and second protective members 515*b*. As shown, the notch 512 is centrally located from side to side of the first protective member 515*a* and extends from a bottom edge of the first protective member 515*a* to a top portion of the first protective member 515*a*, namely, at a bottom edge of the cutout 522 at the top of the first protective member.

Opposing edges of the notch 512 start at outer edges of the bottom of the first protective member 515*a* and curve or bend inward to form the opening of the notch 512. Opposing sides of the notch 512 within the first protective member 515*a* are generally parallel and straight with respect to each other. At the opposite end of the opening at or near the common midsection 318, opposing edges of the notch curve toward each other to define an upper straight back edge at or below the common midsection 318. In one example, the upper straight back edge of the notch 512 rests on an intersecting divider wall.

A cutout 522 includes a slit or elongated slot opening that is centrally located on the common midsection 318 at the top of the protective device 504. The cutout 522 extends down from the common midsection 318 along each protective member 515*a* and 515*b*, but does not extend equally down on both protective members 515*a* and 515*b*. The cutout 522 intersects the top of the notch 512, which is at a higher location on the first protective member 515*a* than the position to which the cutout 522 extends downward along the second protective member 515*b*. As shown, the cutout 522 intersects the center of the top of the notch 512, the cutout 522 having a smaller width than the notch 512. In another example, the cutout 522 extends equally along sides of the first 515*a* and second protective members 515*b*.

The notch 112 is dimensioned with an appropriate length, height, and width to fit around a divider wall 524 and enable the protective device 504 to be secured to the divider wall 524. In an example, the notch 112 includes a height from the bottom edge of the first protective member 515*a* to allow the inner facing surface of the common midsection 318 of the panel member 530 to rest on a top edge of a first divider wall 524 while still allowing adequate space for the intersecting second divider wall 526.

In an example, the notch 112 includes a height that reaches the top of the panel member 530 along the midsection 518. Thus, the midsection 518 and the notch 112 would have a common height for securement around divider walls of equal height. The common height may also accommodate differing heights of divider walls that still benefit from the common heights of the midsection 518 and notch 112.

At the top of the notch 512, near the fold or common midsection 518 of the protective device 504, edges of the notch 512 may be square or rectangular or have curved or rounded corners to prevent sharp edges causing damage to the interior divider walls and golf clubs. Beveling, chamfering, and other configurations for the edges of the notch 512 are anticipated.

Figure 10:
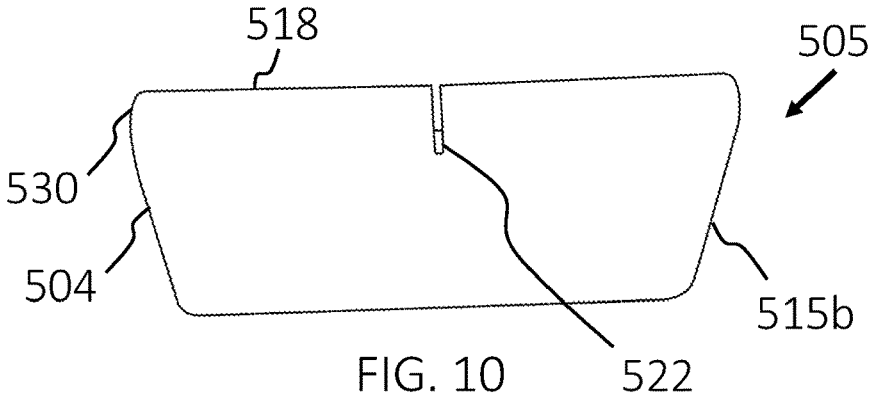
FIG. 10 illustrates a perspective view of a protective device.

FIG. 10 illustrates a perspective view of a protective device 505 with no protective layer 516. As shown, the cutout 522 is centrally located on the panel 504 and extends from the common midsection 518 downward on either side along protective members 515*a* and 515*b*. The cutout defines an elongated slot or slit that provides a narrow elongated opening on the midsection 518 to allow the sides of the panel 505 to bend. The cutout extends perpendicularly downward on either side relative to the long axis of the protective device 505. The cutout 522 may extend only a portion of the way down on either side. For example, the distance on the first 515*a* and second protective member 515*b* may be less than ¼ or less than ⅓ the vertical length of the protective device 505. The width of the cutout 522 is narrower than the notch 512 of the protective device 505. Also, the width of the cutout 522 stays consistent throughout the entire length of the cutout 522. The width of the notch 512 also stays consistent.

Figure 11:
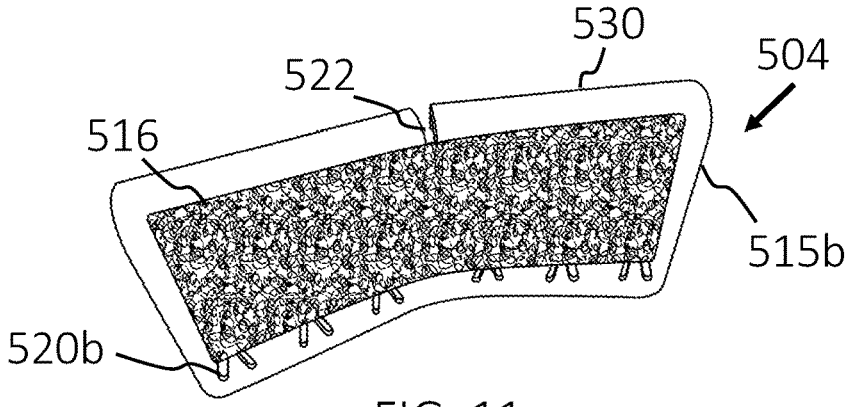
FIG. 11 illustrates a perspective view of a protective device.

FIG. 11 illustrates the protective device 504 having an additional protective layer 516 that spans a distance that is substantially from top to bottom and side to side of the second protective member 515*b*. The layer 516 may extend to, cover, partially cover, or extend past outer facing openings that are associated with the retention elements 521-1, -2 (see FIG. 7). In an example, the layer 516 spans a distance from one outer edge or end portion to less than an end portion, such as half the length of the second protective member 515*b*. In another example, the layer 526 is centrally located and only spans on either side a ¼ of the length of the second protective member 515*b*.

The layer may extend the entire area, or nearly the entire area of the outer facing surface of at least one of the protective members 515*a* and 515*b*. In one example, the layer extends from the common midsection 518 to bottom edges of at least one of the first 515*a* and second protective member 515*b*. The layer 516 or coating may further span a substantial width or the full width of at least one of the first 515*a* and second protective members 515*b*.

In an example, the layer 516 or coating spans from at least an edge of the bottom of the cutout 512 on the second protective member 515*b* to at least a top of at least one retention element 521-1, -2 on the second protective member 515*b*. In another example, the layer 516 spans from at least an edge of the bottom of the cutout 512 on the first protective member 515*a* to at least a top of at least one retention element 520-1, -2 on the first protective member 515*a*.

Figure 12:
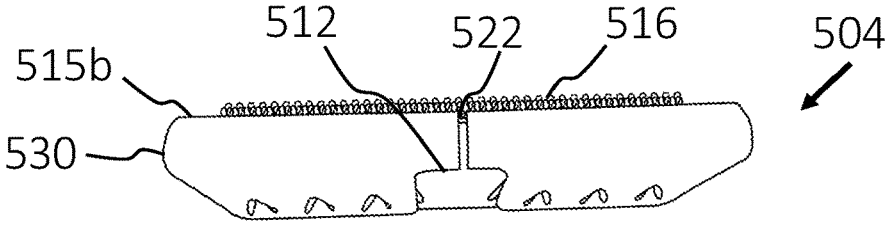
FIG. 12 illustrates a perspective view of a protective device.

FIG. 12 illustrates the protective device 504 in a natural state as a relatively straight member. In an example, the protective device 504 has flexible, resilient properties that allow the panel member 530 to bend or conform to various divider walls. Also, the notch 512 and cutout 522 provide a gap that enables the panel member 530 to be unrestricted in its center region so that it can bend and conform to various divider walls. Particularly, sides of the panel member 530 bend downward to make a concave shape downward and further bend upward to make a concave shape upward. Around the vertical central axis, sides of the panel member 530 bend toward each other on the side of the first protective member 515*a* as well as the reverse direction toward each other on the side of the second protective member 515*b*.

Figure 13:
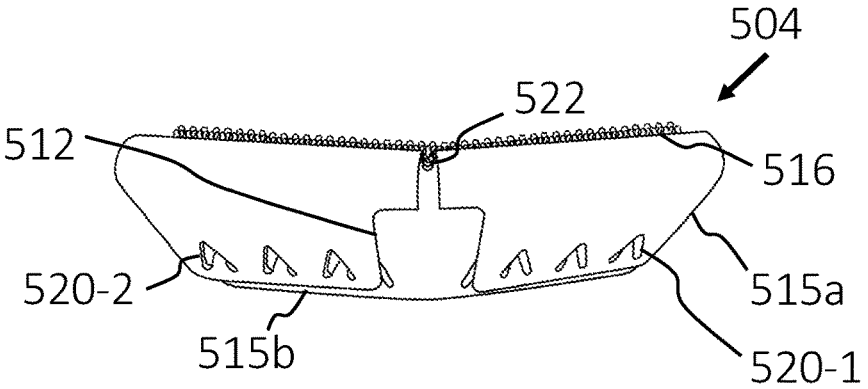
FIG. 13 illustrates a perspective view of a protective device.

In FIG. 13, the panel member 530 is shown with sides bending toward the second protective member 515*b* around the central axis that runs along a center line from the bottom to the top of the panel member 530 with first 515*a* and second protective members 515*b* on either side of the central axis. As shown in FIG. 11, sides of the panel member 530 bend around an axis that extends through the center of the panel member 530 and that is orthogonal to the central axis of the panel member 530. The notch 512 and cutout 522 thus enable the panel member 530 to yield to various curvatures, angles, and positions of the divider walls.

Figure 14:
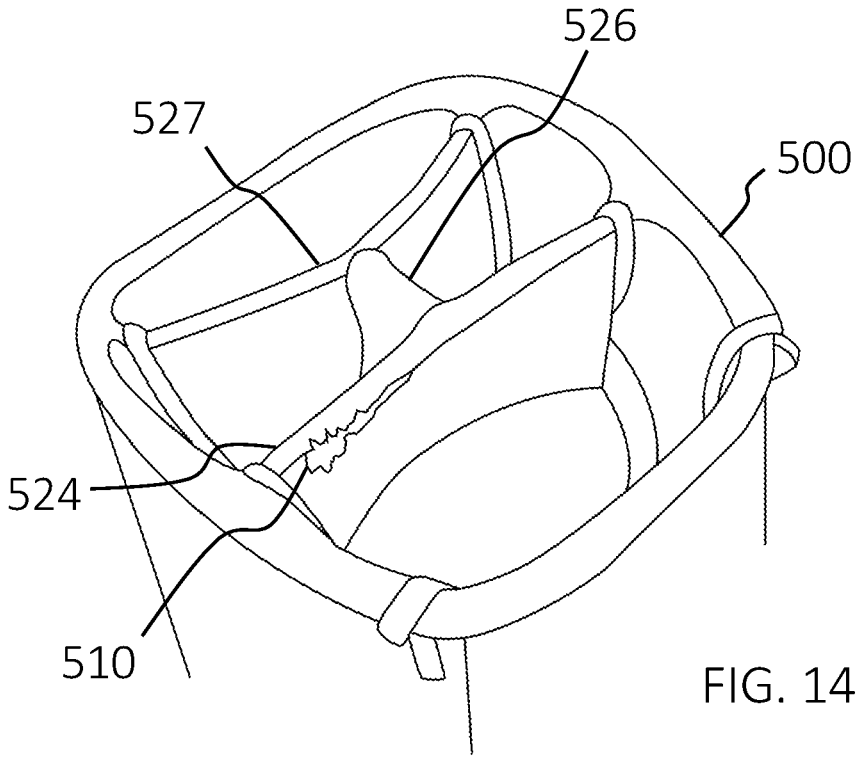
FIG. 14 illustrates a perspective view of a golf bag.

FIG. 14 illustrates a golf bag 500 with a damaged region 510 on a first divider wall 524. The golf bag 500 shown includes first divider 524, second divider 526, and third divider 527. The damaged region 510 may include a tear in a fabric covering on the divider wall 524 or a damage in the divider wall material whether it be plastic or other material.

Figure 15:
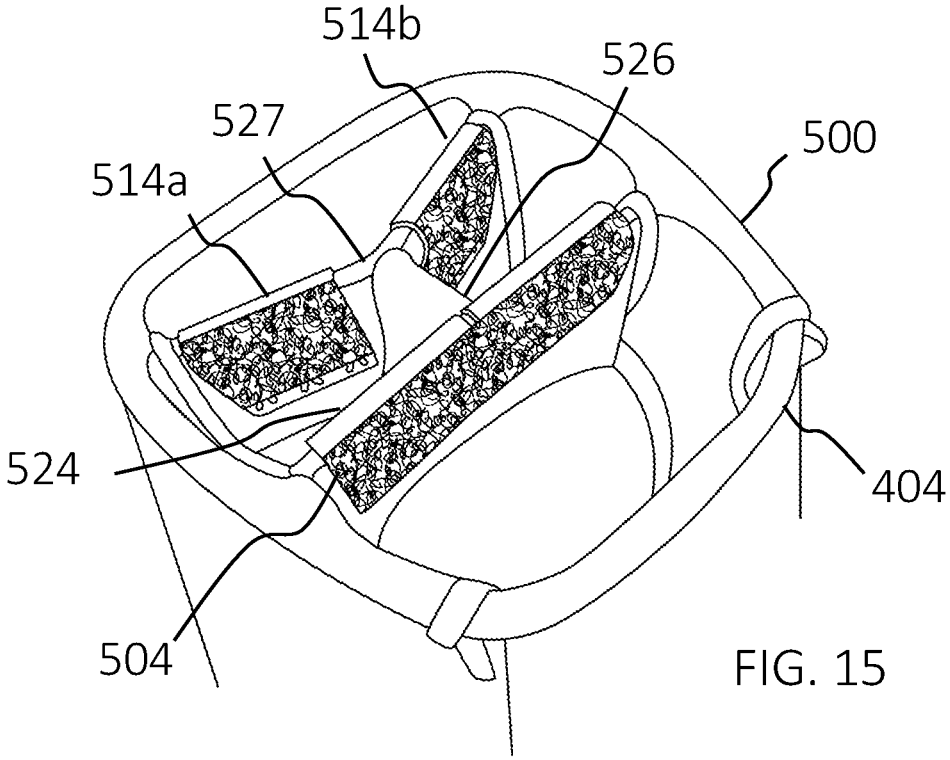
FIG. 15 illustrates a perspective view of a golf bag with a protective device.

FIG. 15 illustrates the protective device 504 inserted over the first divider wall 524 to cover the sides and top of the first divider wall 524. The protective device 504 straddles the first divider wall 524 so as to be balanced on top of the first divider wall 524. The fit may be a tight, friction fit, or a loose fit. In an example, the width of the protective device 504 is to span a substantial portion or majority of a width or the full width of a standard divider wall of a golf club bag. The common midsection 518 has an inner surface facing the divider wall that curves or bends along an arcuate path so that the inner surface of the midsection 518 follows a fit about a circular rim or other surface edge of a divider golf club bag 500.

The notch 512 (see FIGS. 12, 13) provides a space for the intersection of the second divider wall 526 with the first divider wall 524. The cutout 522 enables the panel member 530 to bend and conform to the position of the first 524 and second divider walls 526. The first 524 divider wall may be slanted or curved and the second divider wall 526 may also be slanted or curved. The first 524 and second divider walls 526 may be slanted or curved in opposite directions relative to each other. Moreover, the first 524 and second divider walls 526 may shift and deteriorate over time. They may lose stiffness and slouch in appearance over time. With the space provided by the notch 512 and the cutout 522, along with material properties of the protective device 504, the protective device 504 repositions the position or conforms to the position of the first 524 and second divider walls 526 and helps preserve a stiff backing on which golf clubs can be inserted without destroying the first 524 and second divider walls 526 as well as any other divider walls or the golf bag 500 itself.

Figure 16:
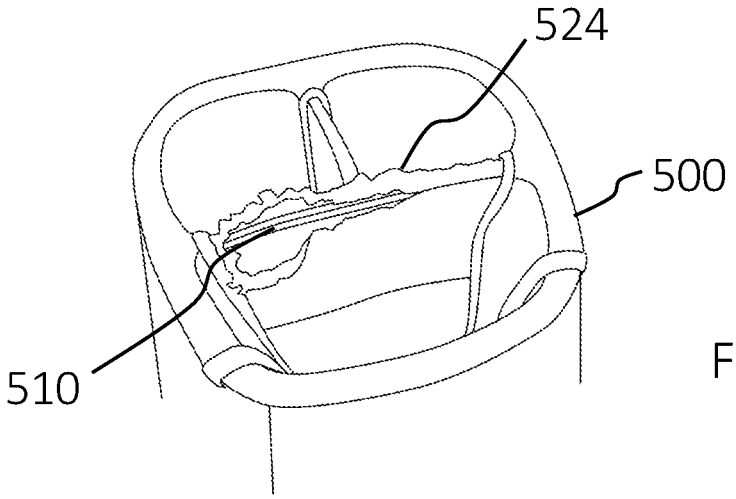
FIG. 16 illustrates a perspective view of a golf bag.
Figure 17:
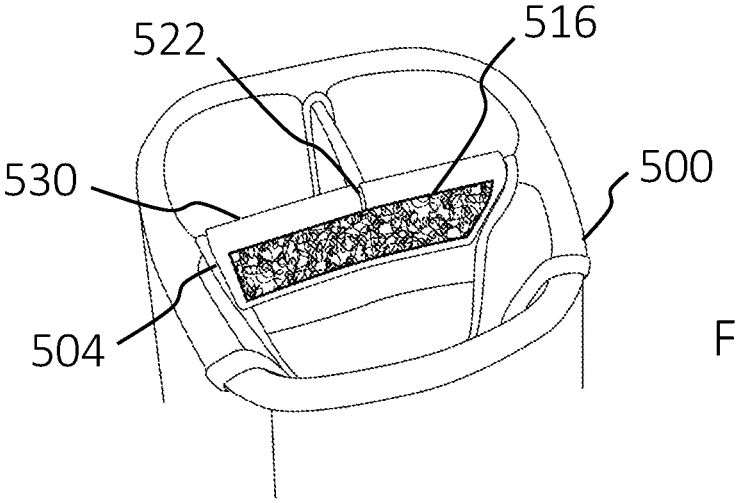
FIG. 17 illustrates a perspective view of a golf bag with a protective device.
Figure 18:
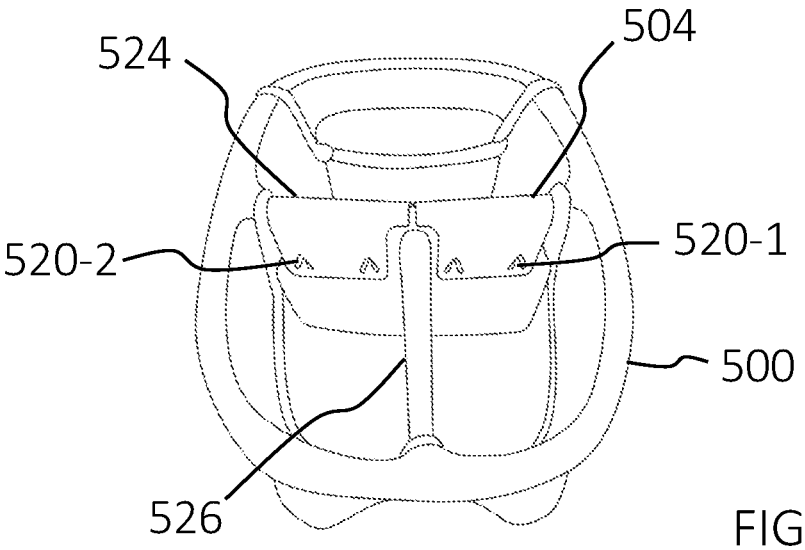
FIG. 18 illustrates a perspective view of a golf bag with a protective device.

FIG. 16 illustrates a golf bag 500 with a damaged region 510. FIG. 17 illustrates a protective device 504 inserted over the first divider wall 524 to cover the sides and top of the first divider wall 524. The damaged region 510 is thus protected from experiencing further immediate damage. Cutout 522 allows the protective device 504 to bend and conform to the position of the first 524 and second divider walls 526. Additional properties of the material of the protective device 504 that allow it to bend and conform may include the material being lightweight and water-resistant.

Figure 19:
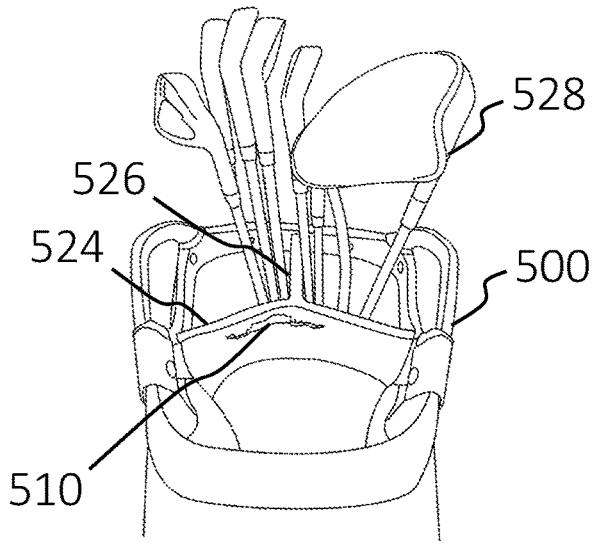
FIG. 19 illustrates a perspective view of a golf bag.
Figure 20:
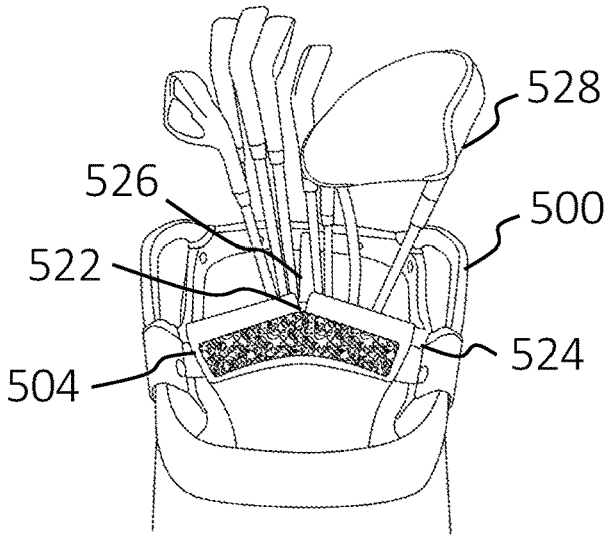
FIG. 20 illustrates a perspective view of a golf bag with a protective device.

FIG. 19 illustrates a golf bag 500 with a damaged region 510. Golf clubs 528 are inserted within the openings defined by first 524 and second divider walls 526. Insertion and removal of the golf clubs 528, along with jostling of the golf clubs 528 during transportation of the golf bag 500, causes damage to the first 524 and second divider walls 526. FIG. 20 illustrates a protective device 504 inserted over the first divider wall 524 to cover the damaged region 510 by covering the sides and top of the first divider wall 524. The notch 512 provides space for the second divider wall 524. Cutout 522 allows the protective device 504 to bend and conform to the position of the first 524 and second divider walls 526. The notch 512 also allows the bending and conforming of the protective device 504.

Each retention element 520-1, -2 and 521-1, -2 (see FIGS. 7-9) engages or attaches to a respective side of divider wall 524 or a surface of a divider wall or is otherwise configured to restrict movement of the protective device 504 relative to the first divider wall 524 of the golf bag 500. Attachment may include that at least one or more of retention elements 520-1, -2 and 521-1, -2 penetrate material on one or both sides of the respective side of a divider wall 524. Restricted movement may include at least one of angular movement, vertical movement, and horizontal movement with respect to the first divider wall 524. The bottom to the top of the first divider wall is consider to be a vertical direction. Side to side of the first divider wall is considered to be horizontal movement. Angular movement is with respect to the horizontal and vertical movement.

Figure 21:
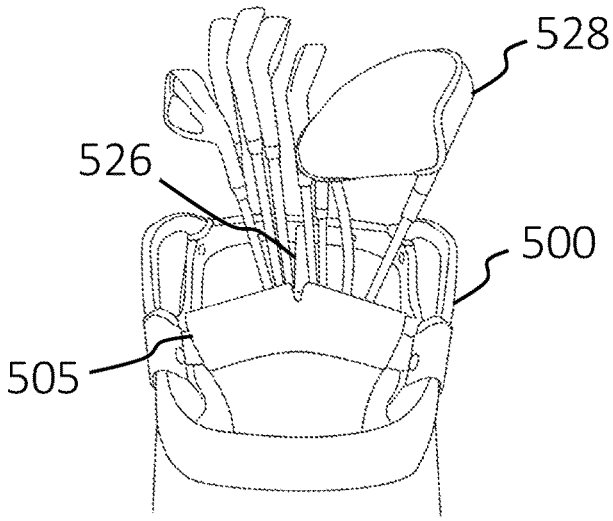
FIG. 21 illustrates a perspective view of a golf bag with a protective device.

In an example, the protective device 504 does not include a layer 516. Like the protective device 504 in FIG. 10, FIG. 21 illustrates a protective device 505 having no layer 516 on either first 515*a* or second protective members 515*b*.

Figure 22:
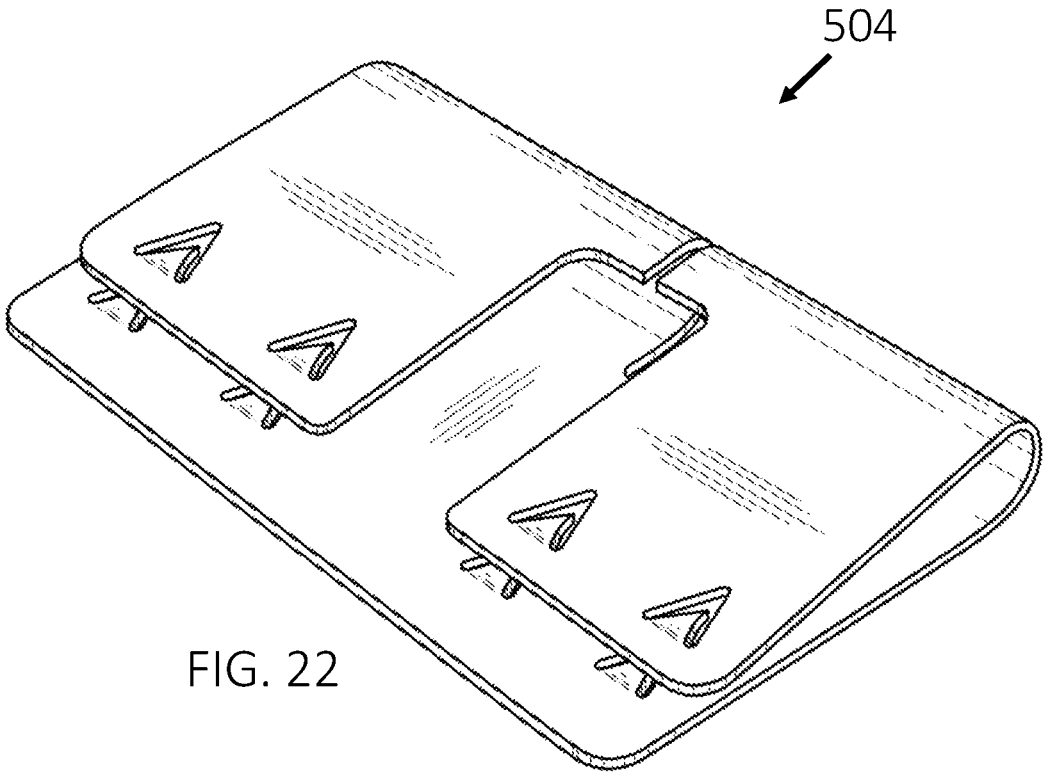
FIG. 22 illustrates a perspective view of a protective device.
Figure 23:
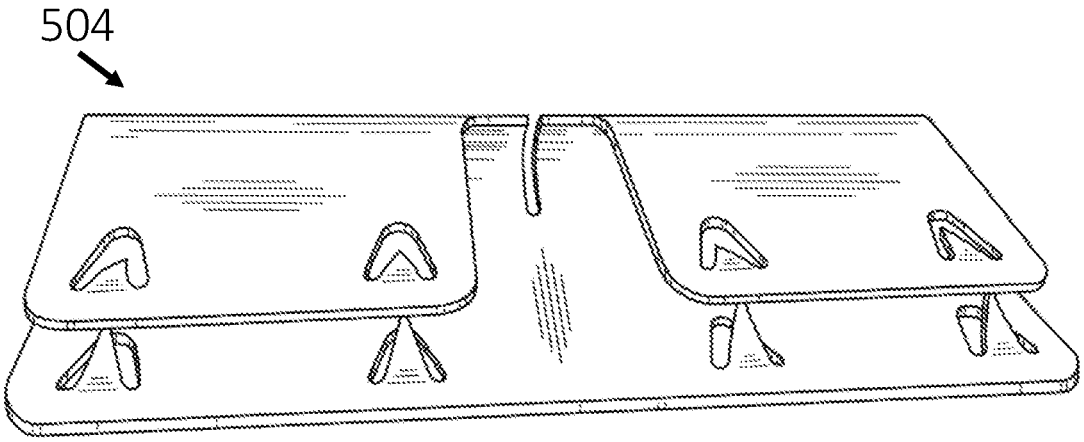
FIG. 23 illustrates a perspective view of a protective device.
Figure 24:
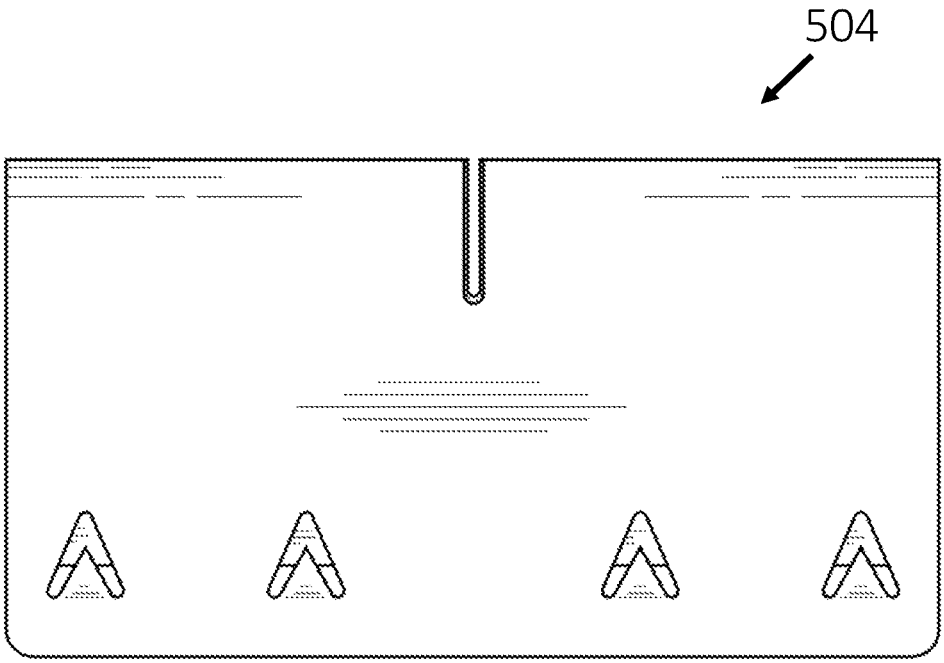
FIG. 24 illustrates a back view of a protective device.
Figure 25:
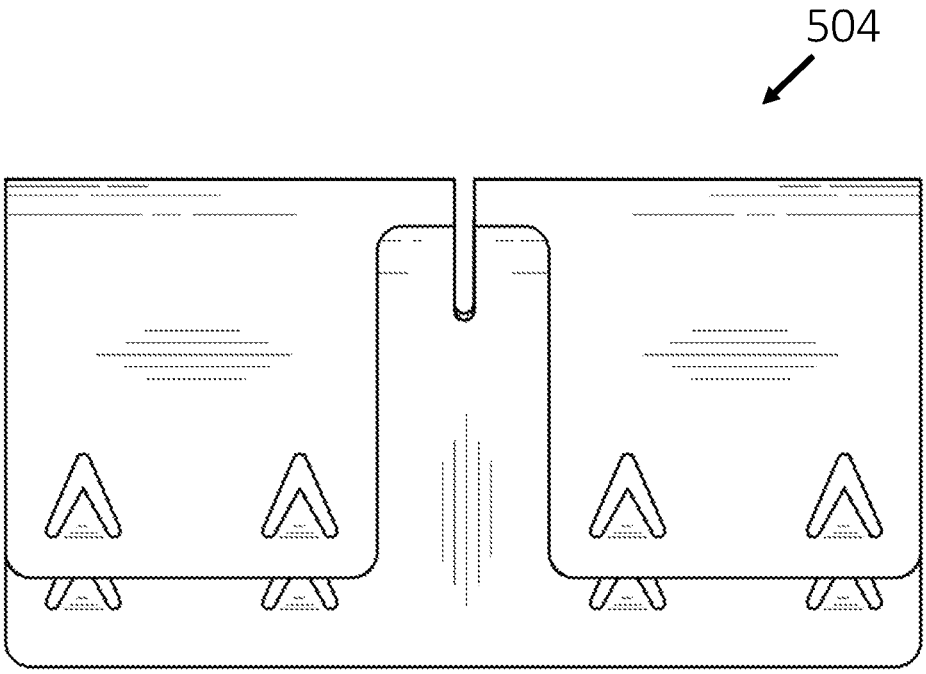
FIG. 25 illustrates a front view of a protective device.
Figure 26:
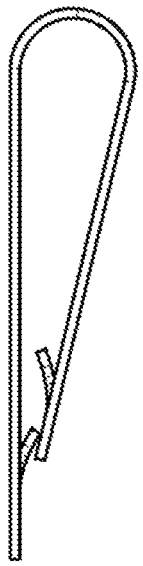
FIG. 26 illustrates a side view of a protective device.
Figure 27:
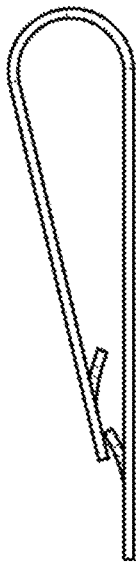
FIG. 27 illustrates a side view of a protective device.
Figure 28:
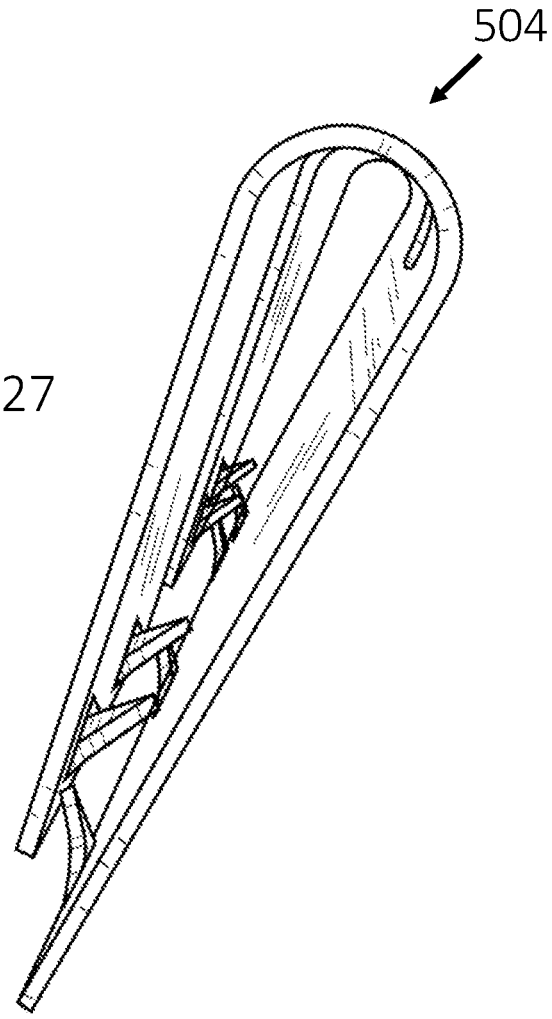
FIG. 28 illustrates a perspective view of a protective device.
Figure 29:
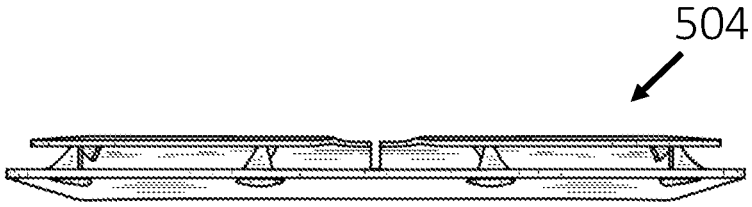
FIG. 29 illustrates a bottom view of a protective device.
Figure 30:
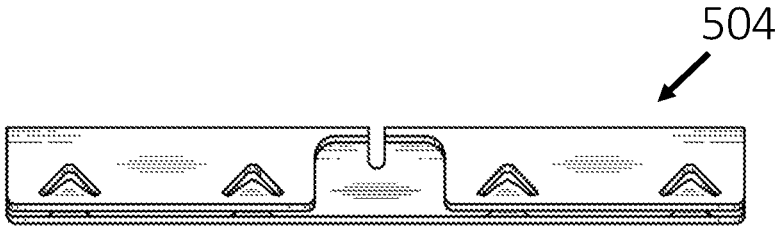
FIG. 30 illustrates a perspective view of a protective device.
Figure 31:
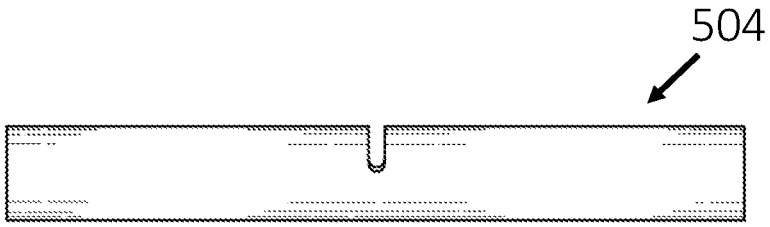
FIG. 31 illustrates a top view a protective device.
Figure 32:
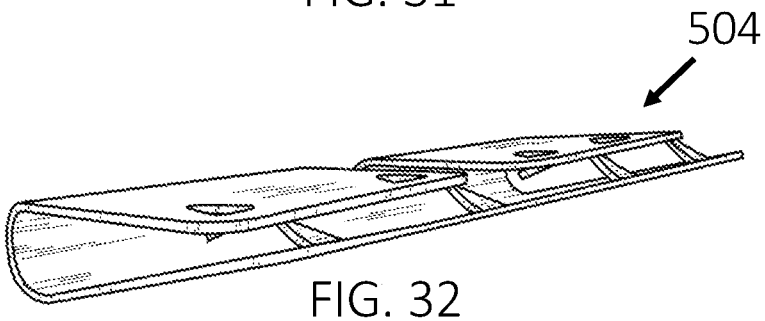
FIG. 32 illustrates a perspective view of a protective device.

FIGS. 22-31 illustrates various views of the protective device 504. For example, FIG. 22 illustrates a perspective view of a protective device. FIG. 23 illustrates a perspective view of a protective device. FIG. 24 illustrates a back view of a protective device. FIG. 25 illustrates a front view of a protective device. FIG. 26 illustrates a side view of a protective device. FIG. 27 illustrates a side view of a protective device. FIG. 28 illustrates a perspective view of a protective device. FIG. 29 illustrates a bottom view of a protective device. FIG. 30 illustrates a perspective view of a protective device. FIG. 31 illustrates a top view of a protective device. FIG. 32 illustrates a perspective view of a protective device.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A protective device for a golf bag comprising:

a panel member folded over to form a U-shape such that a first and second protective member extend from sides of a common midsection;

at least one retention element on an inner facing surface of at least one of the first and second protective members, the at least one retention element to attach at least one of the first and second protective members to a first divider wall so as to prevent movement of the protective device relative to the golf bag, the inner facing surfaces of the first and second protective members otherwise being generally flat;

a notch on the first protective member, the notch dimensioned to allow for an intersection of a second divider wall with the first divider wall; and a cutout centrally located on the common midsection, the cutout extending from the notch on the first protective member and across the midsection to at least a portion of the second protective member, wherein the panel member includes flexible and resilient properties for the panel member to conform to, cover, and be retained on the first divider wall, the notch and cutout further enabling the panel member to bend to conform to the first divider wall and any given curvature of the first divider wall, wherein at least one of the first and second protective members includes a layer of hook and loop material on at least a portion of an outer facing surface.

2. The protective device of claim 1, wherein the retention element includes at least one hook, anchor, prong, spike, or barb that is angled vertically downward and outward relative to the inner facing surface of at least one of the first and second protective members, the retention element to be inserted into a divider wall to hold the protective device in place with respect to the divider wall.

3. The protective device of claim 1, wherein the retention element includes a free end having a tip that is curved or sharp.

4. The protective device of claim 1, further comprising a plurality of retention elements being offset from each other relative to opposite facing sides of the first and second protective members.

5. The protective device of claim 1, wherein the at least one retention element is located at or adjacent to a bottom edge of the first and second protective member.

6. The protective device of claim 1, wherein the at least one retention element is located at or near a bottom corner of at least one of the first and second protective member.

7. The protective device of claim 1, wherein the first protective member is angled relative toward the second protective members, the first and second members having increasing proximity toward free ends.

8. The protective device of claim 1, wherein the first protective member is shorter in length than the second protective member.

9. The protective device of claim 1, wherein at least a portion of at least one of the first and second protective members include a layer or coating.

10. The protective sleeve covering in claim 4, wherein the first surface extends less than a half length of the second surface.

11. A protective device for a golf bag comprising:

a panel member folded over to form a U-shape such that a first and second protective member extend from sides of a common midsection, at least one retention element on an inner facing surface of at least one of the first and second protective members, the at least one retention element to attach the at least one of the first and second protective members to a first divider wall so as to prevent movement of the device relative to the golf bag, the inner facing surfaces of the panel members otherwise being generally flat;

a notch centrally located on the first protective member, the notch dimensioned to allow for an intersection of a second divider wall with the first divider wall; and a layer or coating on at least a portion of at least one of the first and second protective members, wherein the panel member includes flexible and resilient properties for the panel member to conform to, cover, and be retained on a the divider wall, the notch further allowing the panel member to bend to conform to the divider wall and any given curvature of the divider wall, wherein the first protective member is shorter than the second protective member, and wherein at least one of the first and second protective members includes a layer of material on at least a portion of an outer facing surface.

12. The protective device of claim 11, further comprising a cutout centrally located on the common midsection, the cutout extending from the notch on the first protective member and across the midsection to at least a portion of the second protective member.

13. The protective device of claim 12, wherein the cutout extends along the common midsection and intersects with the notch on the first protective member.

14. The protective device of claim 11, further comprising at least one retention element at or near each corner of the first and second protective members.

15. The protective device of claim 11, wherein the at least one retention element is a cutout or punched out prong of the protective device.

16. The protective device of claim 11, wherein the at least one retention element includes a triangular shape.

17. The protective device of claim 11, wherein the layer or coating spans from at least a height of the notch to at least a top of the at least one retention element, the layer or coating further spanning at or near a full width of the second protective member.

18. The protective device of claim 11, wherein a width of the protective device is to span a width of a standard divider of a golf club bag.

19. A protective device for a golf bag comprising:

a panel member folded over to form a U-shape such that a first and second protective member extend from sides of a common midsection;

at least one retention element on an inner facing surface of at least one of the first and second protective members, the at least one retention element to attach the at least one of the first and second protective members to a first divider wall so as to prevent movement of the device relative to the golf bag, the inner facing surfaces of the panel members otherwise being generally flat;

at least a portion of one of the first and second protective members including a layer or coating;

a notch centrally located on the first protective member, the notch dimensioned to allow for an intersection of a second divider wall with the first divider wall; and a cutout centrally located on the common midsection, the cutout extending from the notch on the first protective member across the midsection to at least a portion of the second protective member, wherein the panel member includes flexible and resilient properties for the panel member to conform to, cover, and be retained on the divider wall, the notch and cutout further enabling the panel member to bend to conform to the divider wall and any given curvature of the divider wall, and wherein at least one of the first and second protective members includes a protective layer on at least a portion of an outer facing surface.

* * * * *